United States Patent [19]

Wagner

[11] Patent Number: 5,067,683

[45] Date of Patent: Nov. 26, 1991

[54] PORTABLE TARGET HOLDER

[75] Inventor: Alan M. Wager, Centerville, Ohio

[73] Assignee: Quickfire, Inc., Centerville, Ohio

[21] Appl. No.: 638,866

[22] Filed: Jan. 8, 1991

[51] Int. Cl.[5] ..... F16M 13/00

[52] U.S. Cl. ..... 248/545; 248/156; 273/407

[58] Field of Search ..... 248/156, 545, 121; 273/407; 160/327, 28, 81; 40/606, 611, 607, 610

[56] References Cited

U.S. PATENT DOCUMENTS

| | | | |
|---|---|---|---|
| 2,538,118 | 1/1951 | Miller | 273/407 |
| 3,080,166 | 3/1963 | Clark | 273/407 |
| 3,540,729 | 11/1970 | Rahberger | 273/407 |
| 3,601,353 | 8/1971 | Dale | 160/327 X |
| 4,029,318 | 6/1977 | Boss | 273/407 |
| 4,061,301 | 12/1977 | Catena | 248/156 |
| 4,637,615 | 1/1987 | Foreman | 40/610 X |
| 4,717,110 | 1/1988 | Fohrman | 248/545 |
| 4,811,956 | 3/1989 | Foreman | 273/407 |
| 4,913,389 | 4/1990 | McCracken | 273/407 X |

OTHER PUBLICATIONS

"Portable Frames for Digital Targets" Popular Mechanics; vol. 111, No. 6, Jun., 1959, p. 149.

*Primary Examiner*—J. Franklin Foss
*Attorney, Agent, or Firm*—Biebel & French

[57] ABSTRACT

A target holder comprising a pair of elongated stakes, each of which is fitted with a pivotally mounted spring jaw type target clamp. The stakes each have a tapered lower end and a tongue receiving slot for receiving a stepping bar. The pointed ends of the stakes are driven into the ground by stepping on the stepping bar.

3 Claims, 3 Drawing Sheets

60
30
31
32
37
22
25
24
21
10
40
50
23
54
53
52
51
26

PORTABLE TARGET HOLDER

FIELD OF THE INVENTION

This invention relates to a portable target holder which is easy to assemble, and more particularly to a target stake for holding and supporting a target.

BACKGROUND OF THE INVENTION

The average sportsman who enjoys target shooting experience difficulty in finding targets which are safe and easy to set up. Some shooters therefore use glass bottles, cans, signs and even trees as targets, thus resulting in unsightly litter and damaged property.

U.S. Pat. No. 4,029,318 to Boss attempted to solve this problem. Boss discloses a target stand which is comprised of a pivotally mounted target holder on a scissor frame base, which is adjustable, collapsible, and portable. The target holder is held in position on the frame base by a support rod running from the holder to the base. The targets are held in place by spring operated plastic clips which are slidably mounted. However, a paper target mounted on the Boss disclosure would move if the weather was windy, thereby providing a non-planar target.

U.S. Pat. No. 4,913,389 to McCracken, disclosed a one-piece device for holding shooting and archery targets. McCracken is comprised of an upright member with a ground-penetrating supporting means rigidly attached to its lower end, a metal strip rigidly laid flatly across its upper end, and a plurality of clips which are affixed to the strip and extends perpendicularly from the strip in a direction approximately parallel to the upright member.

Thus there is a need for portable target holder which is easy to assemble, lightweight and inexpensive. Also, the target holder should accommodate various target sizes, and easily penetrate the ground to establish a safe, stable footing. Further, the construction of the target holder should be strong and durable for repeated use. Finally, the holder itself should present the minimum amount of surface to the shooter, thus preventing damage to the holder from misplaced or stray shots.

SUMMARY OF THE INVENTION

In accordance with the present invention, a portable adjustable target holder comprising a pair of target stakes. Each target stake has an elongated channel-shaped metal body. A spring jaw type target clamp is pivotally mounted on the upper end of the stake and has mutually engaging serrated teeth. Each stake has a stepping bar for inserting the lower end of the stake into the ground. The stepping bar has a back and a pair of spaced sides, and a relatively outwardly and upwardly extending retaining tongue formed as a continuation of its back. The tongue is proportioned to be received in a slot in the stake body.

The target holder for holding a target is assembled by positioning two target stakes in such a manner that the space between the stakes is equal to the width of a target. Penetration into a ground surface is achieved by inserting a stepping bar into one of the stake slots, and applying a downward force on the bar until the lowered end of the stake penetrates the surface to a desired depth. Preferably, the stake body is formed with a tapered point at its lower end to facilitate insertion into the ground.

After the stakes are inserted into the ground, a target is positioned between the stake. The vertical marginal or side edges of the target are engaged and gripped by the teeth of the spring clips. If necessary, the clips may be rotated on the stake so as to form a tight grip on the target and hold it straight and flat between the stakes, and to resist flapping of the target in the wind.

It is an object of the present invention to provide an improved portable target holder and holder stake that are inexpensive, lightweight and easy to assemble.

Another object of the present invention to provide a target holder that accommodates a wide variety of targets and target sizes.

It is a further object of the present invention to provide a target holder that is strong, durable and that easily penetrates a ground surface.

It is an object of the present invention to provide a target holder that presents the minimum amount of target surface to a shooter.

These and other objects and advantages of the invention will be apparent from the following description, the accompanying drawings and the appended claims.

DETAILED DESCRIPTION OF PREFERRED EMBODIMENT

Figure 1:
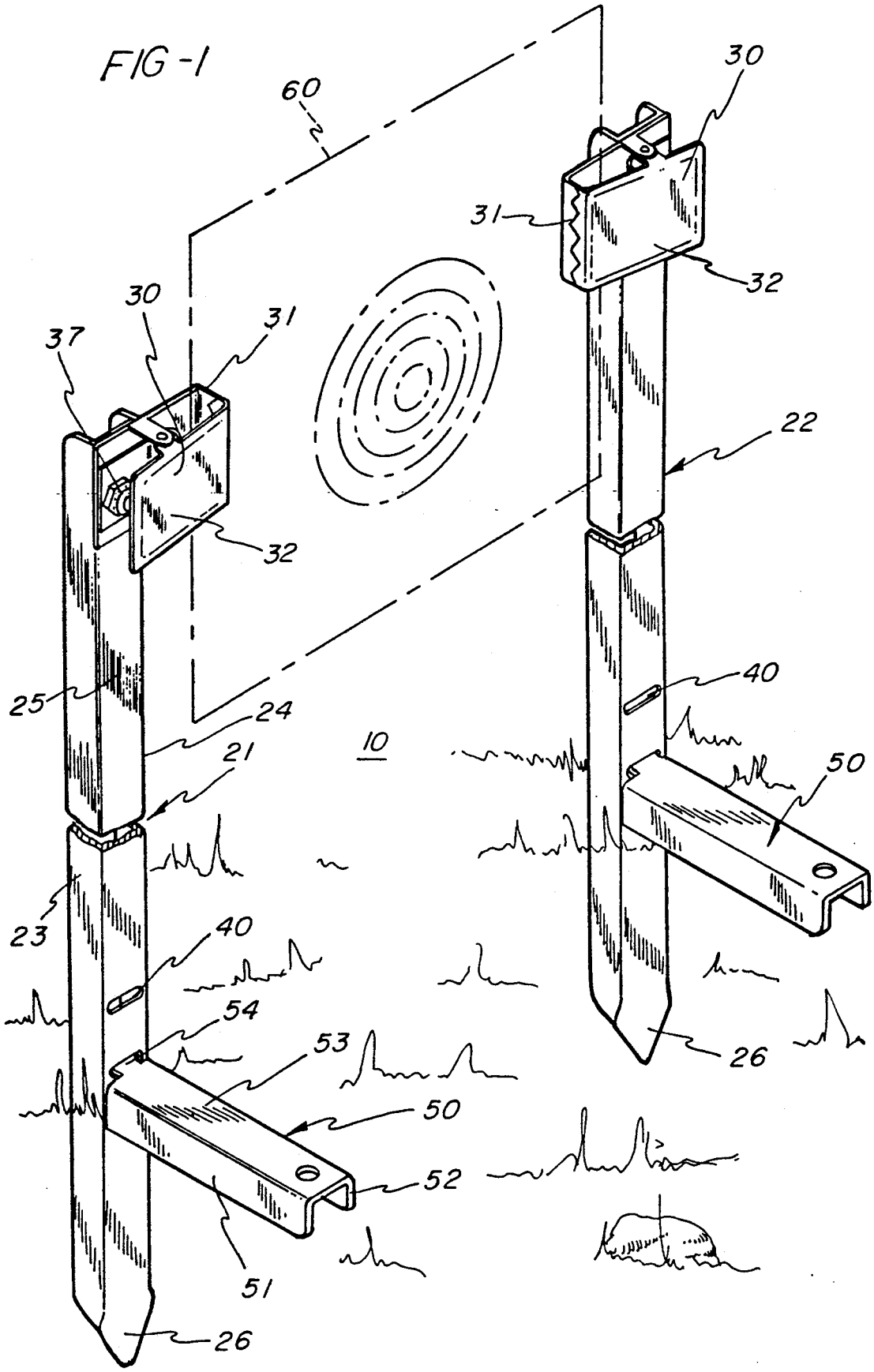
FIG. 1 is a perspective view of the assembled target holder with a paper target supported between the target stakes.
Figure 2:
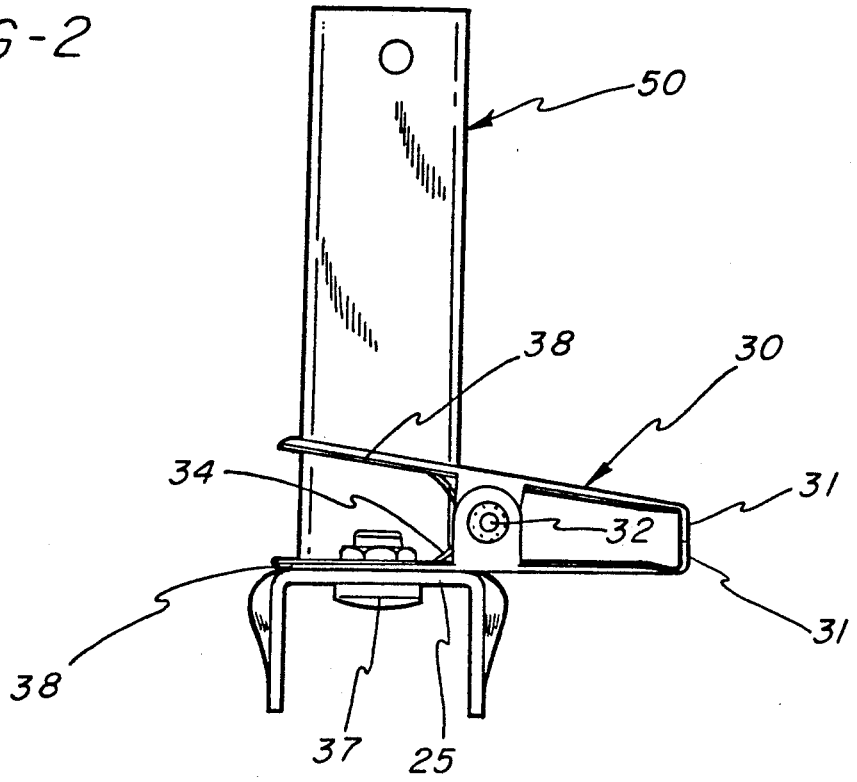
FIG. 2 is a top plan view of one of the target stakes of the invention.

Referring to the drawings, a target holder 10 assembled in accordance with the present invention comprises a pair of elongated stakes 21 and 22. Each stake 21 and 22 has an elongated, channel-shaped metal body defined by a back wall 25 and a pair of parallel spaced-apart side walls 23 and 24, as seen in FIG. 1. The side walls 23 and 24 and back walls 25, at the extreme lower end, are tapered from a point 26 adapted for intersection into the ground, for supporting each channel-shaped body in generally vertical relation with respect to the ground.

Figure 3:
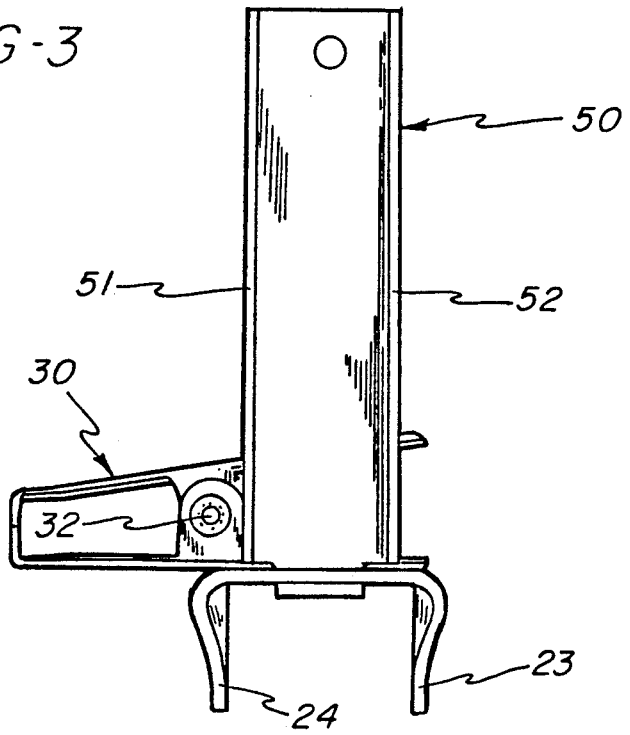
FIG. 3 is a bottom view of a target stake.

A channel-shaped stepping bar 50 is also provided for the pressing of each stake point 26 into the ground. The stepping bar 50 includes a back 53 and a pair of spaced sides 51 and 52. As best shown in FIG. 3, the bars 50 have a relatively outwardly and upwardly extending retaining tongue 54 formed as a continuation of its back 53. The spacing of the bar sides 51 and 52 do not exceed the width of the back wall 25 of the stake body.

Figure 5:
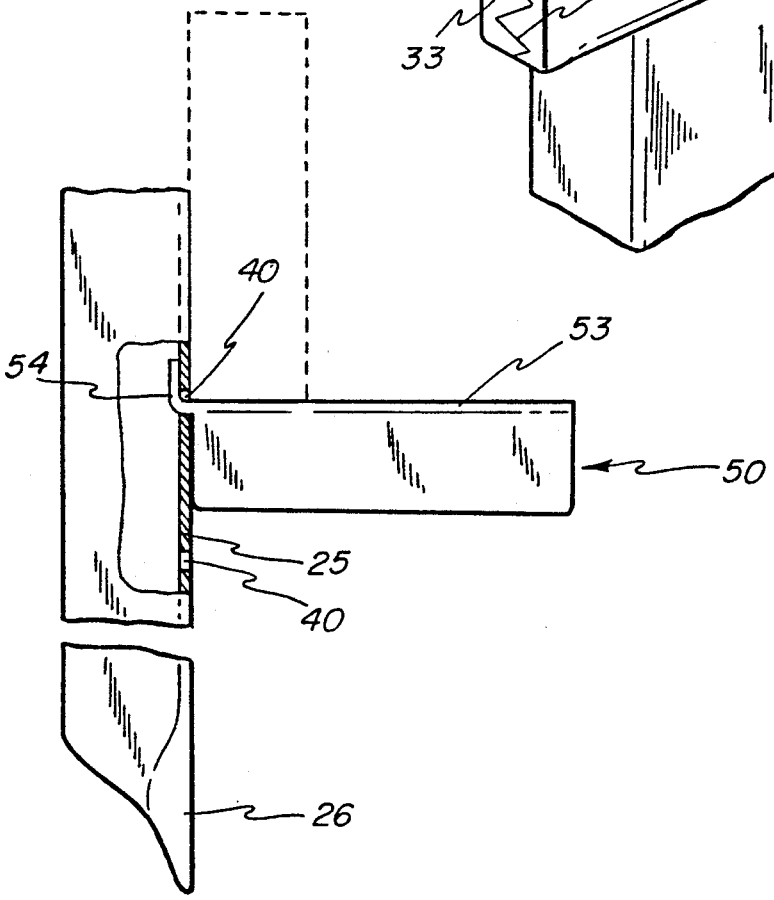
FIG. 5 is a fragmentary side view of a target stake with a stepping bar mounted therein.

Each stake 21 and 22 contains a plurality of vertically spaced tongue-receiving slots 40 in the back wall 25 for receiving the tongue 54 of the stepping bar 50. Preferably, a pair of the vertically spaced-apart slots 40 are formed in the stake wall 25, to permit the selection of the vertical position of the stepping bar 50 on the stakes 20 and 21. The bar 50 sides are in abutment with the back wall 25 of the stake when the bar 50 is extended generally normally to the stake body 45, as shown in FIG. 5. The stake's tapered point 26 may now be pressed into the ground by stepping on the bar 50.

Figure 4:
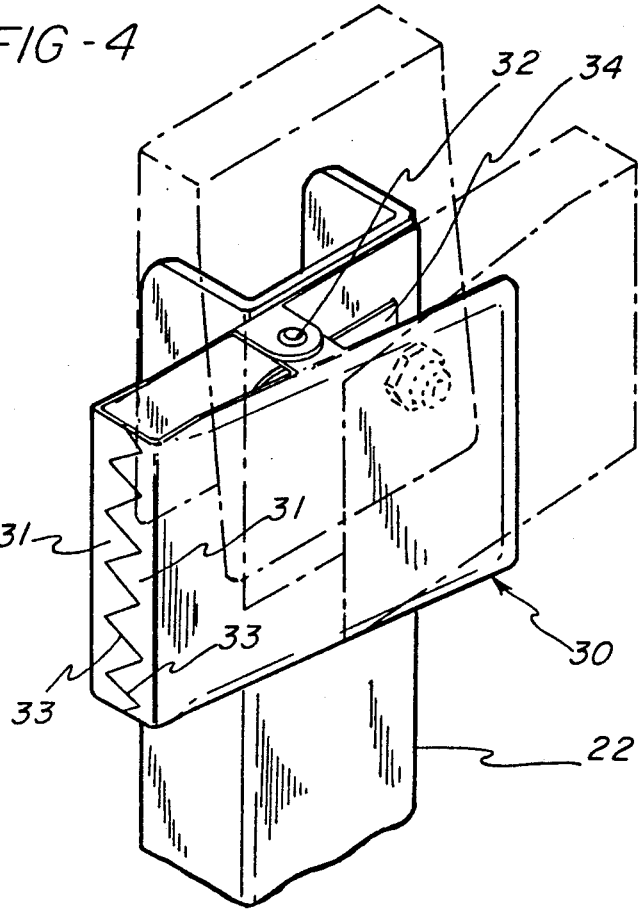
FIG. 4 is a prospective view of the upper end of a target stake with the spring clamp mounted thereon and showing the pivotal movement of the clamp.

A spring jaw type target clamp 30 is pivotally mounted to each stake 21, 22 at the upper end of the stake body. Each clamp is formed with a pair of spring-biased clamping jaws 31 pivoted together for opening and closing movement on rivets 32, as best shown in FIG. 4. Each jaw 31 terminates in interfitted serrated target gripping teeth 33 for penetrating the target at one of the target vertical marginal edges, as shown by the broken lines representing a target 60 in FIG. 1. A U-shaped leaf spring 34 between the jaws 31 biases the jaws 31 together in the closed position, as shown.

Each clamp 30 is pivotally mounted to a stake back wall 25 a the upper end of the stake by a bolt 37. The clamp is easily opened by pressing the opposite extended ends 38 to open the jaw teeth 33. Releasing the clap 30 permits the teeth to close together, and penetrate and grip the target.

After insertions of the target stakes 21, 22, the target 60 may be placed in parallel to the stakes and inserted into the jaws of the target clamps 30, as shown in FIG. 1. The clamps 30 grip the target 60 at the vertical marginal edges and hold the target vertical and flat and resist flapping in the wind. The clamps 30 may be pivoted as necessary to hold the target without wrinkles.

The individual stakes present a low profile to the wind, and to stray bullets. The target holder is versatile in that it is easy to use and readily adjustable to accommodate targets of varying widths and sizes.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A portable target holder comprising:

an elongated stake having upper and lower ends and a channel shaped cross-section defined by a pair of side walls interconnected by a generally planar back wall; one of said walls being provided with a slot near the lower end thereof for releasibly receiving a tongue of a stepping bar; and said side walls being tapered at said lower end for facilitating insertion of said stake into the ground in response to a stepping action on said stepping bar, and a spring jaw clamp pivotally mounted on said back wall near said upper end for selective sideward facing to clamp a first sideward edge of a target in cooperative supporting relationship with an oppositely facing spring jaw clamp mounted on another elongated stake and gripping a second sideward edge of said target.

2. A portable target holder according to claim 1; said slot extending horizontally and being provided in said back wall.

3. A portable target holder according to claim 2; said back wall being provided with a plurality of said slots near said lower end; said slots being vertically spaced for facilitating insertion of said stake into the ground to any of a plurality of different selected depths.

* * * * *

UNITED STATES PATENT AND TRADEMARK OFFICE

CERTIFICATE OF CORRECTION

PATENT NO. : 5,067,683

DATED : Nov. 26, 1991

INVENTOR(S) : Alan M. Wager

It is certified that error appears in the above-identified patent and that said Letters Patent is hereby corrected as shown below:

On the title page, under item [19], "Wagner" should be --Wager--; and

On the title page, under OTHER PUBLICATIONS, "Portable Frames for Digital Targets" should read --"Portable Frames for Pistol Targets"--.

Signed and Sealed this

Eleventh Day of August, 1992

*Attest:*

DOUGLAS B. COMER

*Attesting Officer*

*Acting Commissioner of Patents and Trademarks*